United States Patent [19]

Bolldorf et al.

[11] 4,369,721

[45] Jan. 25, 1983

[54] EMBROIDERING MACHINE WITH THREAD CHANGER

[75] Inventors: Kurt Bolldorf, Kaiserslautern; Ernst Brückner, Neuwied, both of Fed. Rep. of Germany

[73] Assignee: Pfaff Industriemaschinen GmbH, Fed. Rep. of Germany

[21] Appl. No.: 185,895

[22] Filed: Sep. 10, 1980

[30] Foreign Application Priority Data

Sep. 26, 1979 [DE] Fed. Rep. of Germany ..... 2938903

[51] Int. Cl.[3] ..... D05C 3/02

[52] U.S. Cl. ..... 112/98; 112/163; 112/221

[58] Field of Search ..... 112/98, 221, 79 R, 79 A, 112/83, 84, 163, 242

[56] References Cited

U.S. PATENT DOCUMENTS

| | | | |
|---|---|---|---|
| 3,172,380 | 3/1965 | Boyles | 112/221 X |
| 3,695,199 | 10/1972 | Rolauffs et al. | 112/221 |
| 3,884,165 | 5/1975 | Tajima | 112/221 X |
| 4,276,838 | 7/1981 | Bolldorf | 112/221 |

*Primary Examiner*—Peter P. Nerbun

*Attorney, Agent, or Firm*—McGlew and Tuttle

[57] ABSTRACT

A thread changer for an embroidering machine, having a plurality of needles for different threads, comprises, a driving shaft, a plurality of thread levers loosely mounted on the driving shaft, a coupling element for each thread lever connected to the driving shaft and rotatable therewith, and a clutch member connected between the drive shaft and the thread levers for coupling a selected one of the thread levers to the drive shaft to move the selected thread lever into association with a selected one of the needles.

6 Claims, 2 Drawing Figures

EMBROIDERING MACHINE WITH THREAD CHANGER

FIELD AND BACKGROUND OF THE INVENTION

The present invention relates to embroidering machines in general and, in particular, to a new and useful embroidering machine, wherein, in order to effect a thread change, a needle and thread lever associated with the needle are selected from a plurality of needles and thread levers equipped with different threads and coupled with a drive of the embroidering machine.

In a known embroidering machine, according to U.S. Pat. No. 3,884,165, the needle bars and the associated thread levers of a needle group are mounted in a frame-type carrier which brings the selected needle bar and the associated thread lever in front of a stationary drive by displacing the carrier for the purpose of a thread change. The known arrangement requires a considerable amount of space in view of the necessity of accommodating the needle bars and the thread levers in a carrier and particularly because of the required lateral displaceability of the carrier, and thus, also requires considerable expenditures for carrying out the displacement of the carrier.

Embroidering machines are also known where only a single stirrup type thread lever with a number of thread eyes corresponding to the number of needles of this group are provided in each needle group. This arrangement has the disadvantage that the needles which are not involved in the embroidering process are threaded out by the vibrations of the thread and must be threaded in again at the next change of threads. In addition, the same parts of the threads which are not selected for embroidering are always pulled through the thread eyes of the thread levers during the vibration of the thread layer, so that they are unnecessarily stressed for wear.

SUMMARY OF THE INVENTION

The present invention is based on the problem of providing a simple and particularly space-saving arrangement for the thread levers which are associated with the various threads, as well as providing a simple coupling for a drive of the thread lever, which carries the thread selected for embroidering. With the inventive arrangement, it is now possible to limit the space required for a plurality of juxtaposed thread levers and provide for a simple coupling of the levers with their drive, so that the distance from one needle group to the next can be considerably reduced.

Accordingly, an object of the present invention is to provide an embroidering machine having a needle and thread lever associated with the needle which are selected from a plurality of such needles and thread levers equipped with different threads, a device for selecting the thread desired, comprising, a thread lever loosely mounted on a drive shaft, a coupling part connected to the drive shaft and operatively connected to the thread lever, with a coupling clutch connected between the drive shaft and thread lever for engaging the drive shaft to the thread lever and actuating the thread lever.

A further object of the invention, which provides a simplified coupling of the thread lever to the drive shaft, includes, a coupling part or member pivotally mounted on the thread lever and actuated through contact with a contact member for engaging and disengaging the thread lever to the coupling part.

Another object of the invention which provides a simple locking of thread levers which are not involved in embroidering, comprises, a hold-back bar which is engageable with a stop on the coupling element to retain the thread lever in a disengaged position.

A still further object of the invention is to provide a thread change mechanism for an embroidering machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
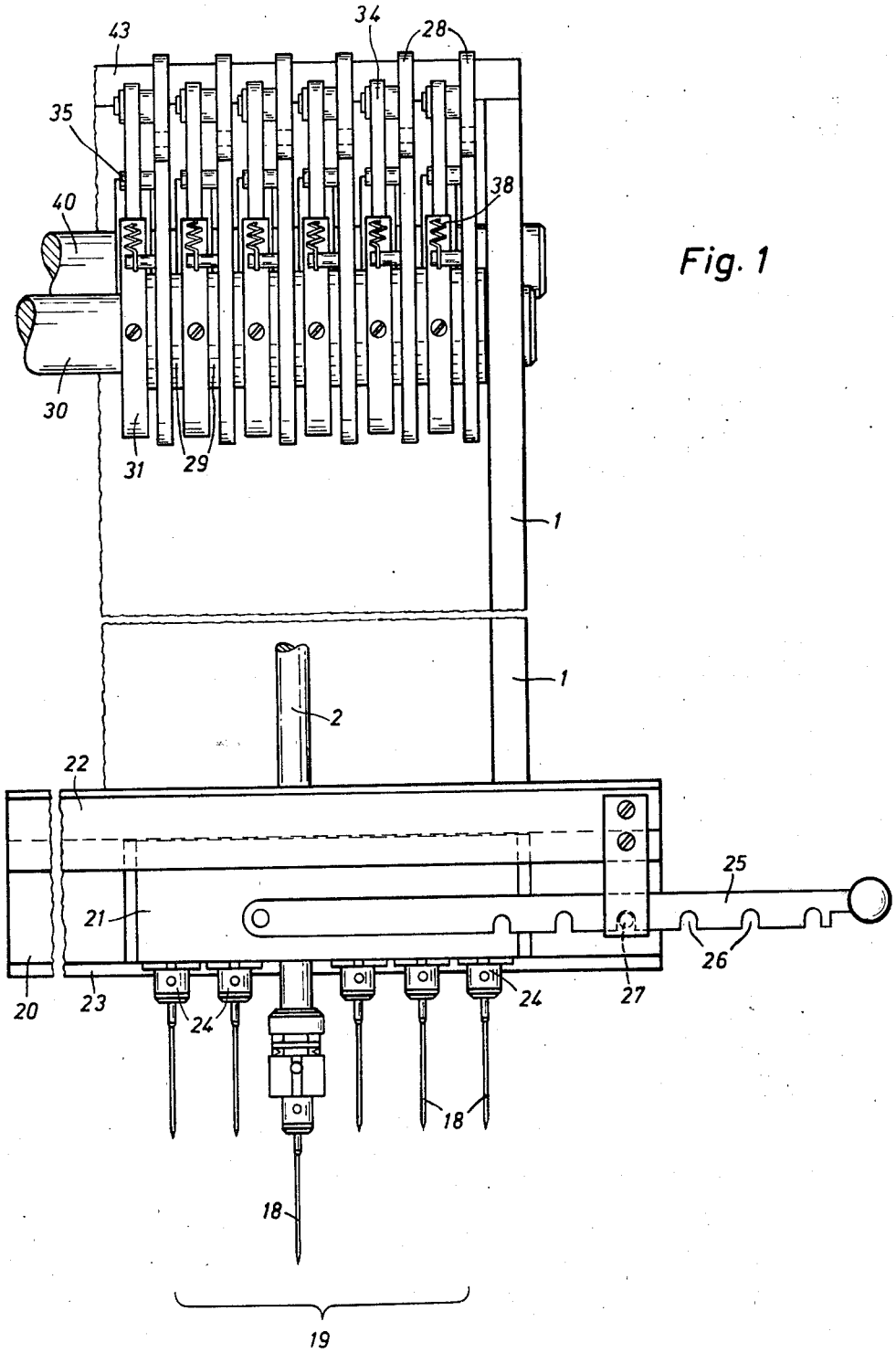
FIG. 1 is a front elevational view of one embodiment of a thread changer in an embroidering machine, according to the invention, showing a needle group with an associated thread lever group.

Referring to the drawings in particular, the invention embodied therein, comprises, a thread changer for an embroidering machine having a mounting frame 1, carrying a plurality of thread levers 28 and a needle bar 2.

FIG. 1 shows the mounting frame 1 of the embroidering machine in which the needle bar 2 is mounted. Needle bar 2 is connected over a needle bar member 3 (FIG. 2) and a guide rod 4 with a crank 5 which is loosely mounted on a swing shaft 6, mounted in mounting frame 1 for driving the needle bar 2. Crank 5 is guided axially by a follower secured on swing shaft 6, and an adjusting ring (not shown) is likewise mounted on swing shaft 6. A pawl 9 is mounted on crank 5, on an axle 8. Pawl 9 is provided with a coupling tooth 10, which is moved, under the action of a spring 11 connected between pawl 9 and crank 5, into a transverse groove 12 in follower 7. Swing shaft 6 is thus coupled with needle bar 2 and causes its ascending and descending movements between a lower dead center with member 3 at UT and an upper dead center at OT.

Pawl 9 has a contact arm 13 which is, in an upper shifting position OS of needle bar 2, opposite a displaceable contact arm 14, which forms a part of an uncoupling device or means 15. Stop surfaces 16 are provided on cranks 5, which bear on a registering bar 17 when member 3 is in a shifting position of needle bar 2 designated at OS.

A plurality of needles 18, to be equipped with different threads, is assigned to needle bar 2 (FIG. 1). Several needles 18 are combined to form a so-called needle group 19, and are assigned to a certain stitch-forming area of the embroidering machine. A guide 20 is provided on mounting frame 1 for a magazine 21, extending transversely to the longitudinal axis of the needle bar 2, which can be moved inside guide 20 transversely to the direction of motion of needle bar 2, and which is held in guide 20 by two ledges 22, 23 which, at the same time, serve to form guide 20. A plurality of needle holders 24 are arranged in magazine 21 side-by-side. The needle holders 24 carry needles 18 which are equipped with different threads.

In order to displace magazine 21 and to secure its relative position, a magazine lever 25 is pivotally mounted on magazine 21, which has a number of recesses 26 corresponding to the number of needle holders 24, which can be engaged by a pin 27 carried by mounting frame 1. Magazine 21 is designed as a profiled piece with a substantially U-shape cross-section, whose open side faces the needles 18. Other details of the needle changer are described in detail in German Patent Appln. No. P 29 27 142.9 (U.S. Patent Appln. Ser. No. 165,799).

Figure 2:
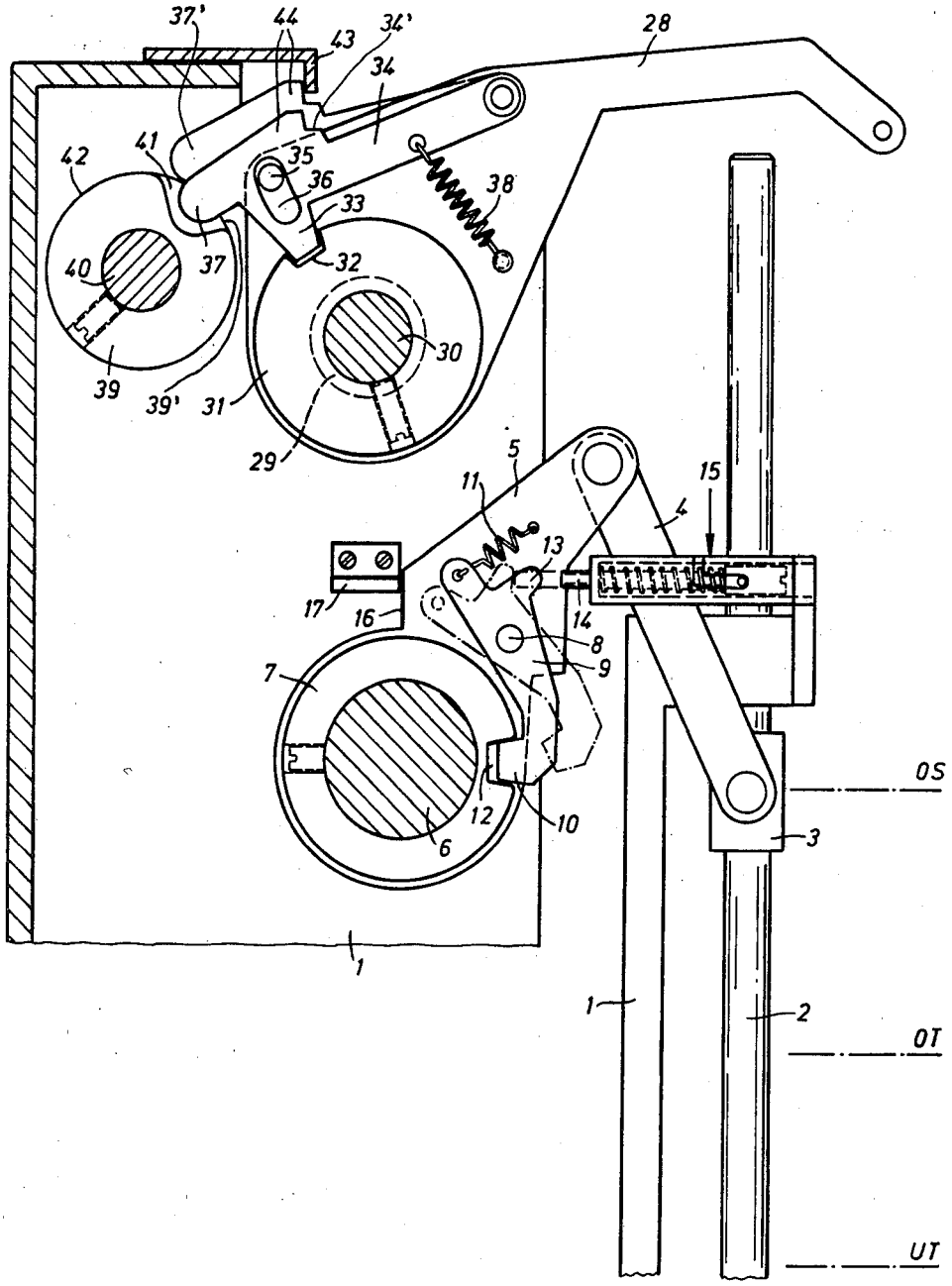
FIG. 2 is a side elevational view, partially in section, of the needle bar and thread lever drive arrangement.

A thread lever 28 is assigned to each needle 18 (see also FIG. 2). These are connected with lateral ring bearings 29 which are mounted and spaced from each other on swing shaft 30 mounted in mounting frame 1 for driving thread levers 28.

In addition to a ring bearing 29 of each thread lever 28, an annular coupling part 31 is secured on swing shaft 30. Coupling part 31 is provided with a U-shape coupling groove 32 into which can be inserted a correspondingly designed coupling tooth 33 of a coupling element 34, which is pivotally mounted on thread lever 28. The swinging range of coupling element 34 is limited by a pin 35 secured in thread lever 28, which protrudes into an oblong slot 36 of coupling element 34.

A lug 37 of coupling element 34 bears on a contact element 39 under the action of a tension spring 38 arranged between coupling element 34 and thread lever 28. Contact element 39 is secured on a control shaft 40 extending parallel to swing shaft 30.

A plurality of juxtaposed contact members 39 (only two are shown in FIG. 2) of thread levers 28 have angularly displaced recesses 41, which permit the turning of the selected coupling element 34 until its coupling tooth 33 drops into coupling groove 32 of coupling part 31. Lug 37' of the other coupling element 34', bear on the circumferential surface 42 of the corresponding contact element 39', as do other lugs (not shown).

A hold-back bar 43 is secured on mounting frame 1 behind which a stop 44, molded on each coupling element 34, can move. In order to change from one thread to another, needle bar 2 is stopped in its upper dead center position with needle bar member 3 at position OT. An additional rotation is then imparted to swing shaft 6 until needle bar 2 is in the position designated in FIG. 2 by OS. Needle holder 24 is thus retracted into magazine 21 and is uncoupled in a known manner, as described more fully in German Patent Application No. P 29 27 142.9 (U.S. application No. 165,799 now U.S. Pat. No. 4,276,838).

After unlocking magazine lever 25, magazine 21 is displaced inside of guide 20 until needle holder 24, carrying the desired thread, is aligned with needle bar 2.

After locking magazine 21 in its new position, swing shaft 6 is turned back into its position corresponding to the upper dead center OT of needle bar 2. Needle bar 2 is coupled with the newly selected needle holder 24 during its move into the OT position.

With the selection of a new thread by coupling another needle holder 24 with needle bar 2, thread lever 28 carrying the thread to be first embroidered must be disengaged, and thread lever 28 carrying the new thread must be coupled with swing shaft 30. This is done by turning control shaft 40, with needle bar 2 in the upper shifting position OS, by hand or over a mechanical connection (not shown), between lever 25 and control shaft 40. Circumferential surface 42 of contact element 39, associated with thread lever 28, which has just been engaged, lifts coupling element 34 and thus lifts coupling tooth 33 out of coupling groove 32. At the same time, stop 44 snaps-in behind hold-back bar 43, so that thread lever 28, as well as the other disengaged thread lever, is held in the lifted position.

Control shaft 40 is now turned until recess 41 of thread lever 28 carrying the selected new thread is opposite lug 37 of coupling element 34 assigned to this thread lever 28, which can now engage with its coupling tooth 33, coupling groove 32 under the action of spring 38 and couple thread lever 28 with swing shaft 30.

The engagement and disengagement of needle bar 2 is likewise effected in the upper shifting position OS. For disengagement, contact arm 14 is pushed toward contact arm 13 of pawl 9 and pawl 9 is turned. Coupling tooth 10 lifts out of transverse groove 12 of follower 7, since crank 5 bears with its stop surface 16 on registering bar 17. Contact rod 4 is locked in this position and holds crank 5 and thus needle bar 2 in its disconnected position.

For engaging needle bar 2 again, contact rod 14 is brought from its locked position into its retracted position in uncoupling device 15. Contact arm 13 of pawl 9 is thus released, so that its coupling tooth 10 moves under the action of spring 11 into transverse groove 12 of follower 7 and couples needle bar 2 with swing shaft 6.

While a specific embodiment of the invention has been shown and described in detail to illustrate the application of the principles of the invention, it will be understood that the invention may be embodied otherwise without departing from such principles.

What is claimed is:

1. A thread changer for an embroidering machine, having a plurality of needles for different threads, comprising, drive means, a plurality of thread levers loosely mounted on said drive means, a coupling part for each thread lever connected to said drive means and movable with said drive means, and clutch means connected between said drive means and thread levers for coupling a selected one of said thread levers to said drive means to move said selected one of said thread levers into association with a selected one of the needles.

2. A thread changer for an embroidering machine, as claimed in claim 1, wherein said clutch means comprises a coupling lever movably mounted on each of said thread levers, a contact element movably mounted adjacent said coupling levers and contactable with said coupling levers to selectively actuate one of said coupling levers for engaging and disengaging said selected one of said thread levers to said coupling part.

3. A thread changer for an embroidering machine, as claimed in claim 2, wherein each of said coupling levers comprises a three-arm control lever having one arm pivotally mounted to each of said thread levers, respectively, a second arm comprising a coupling tooth, and a third arm comprising a lug movable into a path of motion of said contact lever, said coupling part including a groove into which said coupling tooth is engageable and said contact element including an indentation into which said lug is engageable to permit engagement of said coupling tooth into said coupling part groove.

4. A thread changer for an embroidering machine, as claimed in claim 3, wherein each of said coupling levers include a stop, a hold-back bar mounted to said engaging machine in a position to engage with each of said stops respectively when said thread levers are in a disengaged position with said drive means.

5. A thread changer for an embroidering machine, as claimed in claim 1, wherein said drive means comprises a shaft, each of said coupling parts includes an annular disc fixedly mounted to said shaft having a coupling groove at a circumferential location thereon, said clutch means comprising a three-armed coupling element pivotally mounted about a first arm to each of said thread levers, a rotatably mounted contact element connected to the embroidering machine having an outer circumference contactable with a second arm of said coupling lever, said contact element having a recess therein into which said second arm is movable to engage a third arm of said coupling lever into said groove of said coupling part.

6. A thread changer for an embroidering machine, as claimed in claim 5, including a spring biasing said coupling lever toward said coupling part.

* * * * *